US006484763B1

(12) United States Patent
Derntl

(10) Patent No.: US 6,484,763 B1
(45) Date of Patent: Nov. 26, 2002

(54) DEVICE FOR TRANSPORTING FLUIDS, SUCH AS VISCOUS ADHESIVES OR SEALANTS

(75) Inventor: Norbert Derntl, deceased, late of Barum (AT), by Horst Hiemisch, legal representative

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 09/504,057

(22) Filed: Feb. 14, 2000

(30) Foreign Application Priority Data

Feb. 15, 1999 (DE) ..... 29902514 U

(51) Int. Cl.[7] ..... B67C 3/26; B67C 3/34

(52) U.S. Cl. ..... 141/259; 141/146; 141/147; 141/258; 141/261; 222/380; 222/387

(58) Field of Search ..... 141/18, 21, 27, 141/144–147, 258–262, 127; 222/380, 386, 387

(56) References Cited

U.S. PATENT DOCUMENTS 3,841,363 A * 10/1974 Stigler ..... 141/142
3,978,900 A * 9/1976 Mencacci et al. ..... 141/11
4,842,026 A * 6/1989 Nordmeyer et al. ..... 137/246
5,230,373 A * 7/1993 Engler ..... 141/146

* cited by examiner

*Primary Examiner*—Timothy L. Maust
(74) *Attorney, Agent, or Firm*—Wood, Herron & Evans, L.L.P.

(57) ABSTRACT

A device for transporting fluids, such as viscous adhesives and sealants. The device includes a cylinder which may be filled by a supply line and a movable piston within the cylinder for ejecting the fluid into a discharge line. The piston includes an axial fluid channel and can be moved by way of a piston rod which also includes an axial fluid channel. An inlet valve is positioned between the supply line and the cylinder and may be moved between open and closed positions for releasing or interrupting the supply the fluid from the supply line into the interior of the cylinder. The piston rod includes threading and this threading is engaged with corresponding threading on a rotatable and drivable drive element so that the piston may be moved by rotating the drive element within the cylinder.

11 Claims, 2 Drawing Sheets

DEVICE FOR TRANSPORTING FLUIDS, SUCH AS VISCOUS ADHESIVES OR SEALANTS

This application claims the priority of German Patent Application No. 29902514.4 filed Feb. 15, 1999, the disclosure of which is hereby fully incorporated by reference herein.

1. Field of the Invention

The present invention pertains to a device for transporting fluids, especially viscous adhesive or sealing materials, with a supply line which can be connected to a source of fluid, a cylinder which can be filled with fluid by means of the supply line, and a movable piston inside the cylinder for ejecting fluid which is in the cylinder into a discharge line which communicates with the interior of the cylinder. The piston has an axial fluid channel and can be moved by means of a piston rod which has an axial fluid channel, with an inlet valve positioned between the supply line and the cylinder which can optionally be moved to open and closed positions to release or interrupt the supply of fluid from the supply line to the interior of the cylinder.

2. Background of the Invention

Known devices generally related to the present invention are used in order to transport adhesives or other fluids in measured quantities. One such device is known from the disclosed German patent application DE 42 11 370 A1. In the known transport device, a piston which is connected to a hollow tappet, having an axial channel which is connected to the cavity of the tappet, can be moved by means of a pneumatic or hydraulic drive cylinder inside a transport cylinder in such a way that fluid from the transport cylinder is ejected through the fluid channel formed in the piston and the hollow tappet and into a flexible line. The disadvantages here are the relatively long flow paths of the fluid through the piston, the hollow tappet and the hose.

In addition, only a relatively imprecisely measured quantity of fluid can be transported by means of the pneumatic drive cylinder. An additional disadvantage consists in the fact that the known transport device is a relatively large construction due to the pneumatic cylinder which drives the displacement piston. Furthermore, the transport of the fluid is subject to variations, since the gas in the pneumatic cylinder is compressible and there can therefore be variations in pressure in the pneumatic cylinder and uneven movement of the piston.

From the public application papers for 20 38 369, a cylinder pump is known which has a piston which can be moved in a cylinder by means of a piston rod, where one end of the piston rod has threading which engages a rotatable threaded sleeve in order to axially move the piston rod and thus the piston. A disadvantage of this device is that so-called dead spaces can occur in the cylinder chamber, in which fluid collects and is not ejected from the cylinder chamber over the period of several strokes of the piston. Furthermore, because of the dead spaces there can be unwanted temperature changes in the fluid, due to the fact that a quantity of fluid which is the first to be drawn into the cylinder cools down within the cylinder, and is not pressed out of the cylinder chamber until the end of the ejection stroke of the piston, whereas fluid which is last drawn into the cylinder is the first to be pressed out of the cylinder chamber again with the help of the piston.

SUMMARY OF THE INVENTION

The present invention is based on the task of providing a device to transport the fluid which avoids the disadvantages of the state of technology and makes it possible to transport an exactly measured quantity of a fluid, having compact and simple construction, and which in particular makes it possible to transport small quantities of fluid.

The invention accomplishes this task by providing the fluid transport device with a threaded piston rod. The threading on the piston rod engages corresponding threading on a drive element which is mounted so that it can rotate and can be propelled in a rotating manner, so that the piston can be moved in a cylinder by means of rotating the drive element.

The advantages of the invention consist mainly in the fact that by means of the corresponding threading on the piston rod, which has an axial fluid channel, and the drive element, measured transport of fluid with very exactly adjustable transport flows is realized, and at the same time there is the guarantee that because of the fluid channels formed in both the piston and the piston rod it is possible to fill the interior of the cylinder through these interconnected fluid channels, so that a quantity of fluid which is the first to reach the interior of the cylinder, after flowing through the interior of the cylinder, is the first again to be ejected, without small or even larger quantities of fluid collecting in a dead space in the cylinder and remaining in the cylinder longer than other quantities of fluid (first-in-first-out principle). By means of the combination, in accordance with the invention, of a piston rod which can be propelled with the help of threads, and the piston rod which has a fluid channel and a piston which also has an axial fluid channel, a compact design is realized for the device.

In an especially preferred manner, the piston rod is designed as a hollow spindle with male threads, and the drive element is designed as a threaded sleeve with female threads, since in this manner the double function of the piston rod in the form of a hollow spindle which serves on the one hand as the supply line for feeding the fluid into the interior of the cylinder and on the other hand as a means of propulsion for moving or shifting the piston inside the cylinder in order to draw fluid into or press it out of the piston can be realized with an especially compact and simple design.

In a manner which is likewise preferred, the implementation variant just described is further advanced by having the threaded sleeve mounted in a fixed location by means of a roller bearing on a housing and propellable by means of an electric motor, and by having gears between the threaded sleeve and the electric motor. The threaded sleeve, which is engaged with the hollow spindle in order to move the threaded sleeve and the piston axially, is thereby permanently and precisely mounted, and because of the gearing it can be driven at relatively low rotational speed, depending on the desired quantity to be transported, so that the piston is shifted in the cylinder at relatively low speed, in order to be able to transport relatively small quantities. At the same time, because of the gears, which preferably provide for a reduction in the speed of the electric motor, when the rotary speed of the drive element is low a relatively high torque is guaranteed in the drive element, so that the piston is moved in the cylinder with a relatively high force, so that variations in transport quantity can largely be avoided even with highly viscous fluids.

A gear system of relatively simple and reliable design consists in a gearset with a toothed belt, which works together with a gear wheel which is coupled to the threaded sleeve and another gear wheel which is coupled to the drive shaft of the electric motor.

In an especially preferred manner there is provision for the fluid flow path between an end section of the hollow spindle at the opposite end from the piston and the supply line to be interruptible by means of the inlet valve, for the inlet valve to be movable together with the hollow spindle, and for the supply line to be in the form of a flexible hose. The inlet valve is moved to the open position in order to fill the interior of the cylinder, and in this position the piston is shifted in such a way that fluid flows into the interior of the cylinder through the hollow spindle and the fluid channel formed in the piston. After the piston has reached its end position, the inlet valve is closed, and in order to transport fluid the hollow spindle can now be moved together with the piston by rotating the drive element, with the effect that fluid is pressed from the interior of the cylinder into a discharge line, which is preferably connected directly to the cylinder. By means of the flexible hose, the movements of the hollow spindle and the inlet valve can be adjusted relative to a fixed fluid source without problem.

In accordance with an additional preferred variant form it is proposed that the hollow spindle be guided at its end opposite the piston, and if appropriate that the inlet valve be guided by means of a linear guide. By having the piston guided axially inside the cylinder, on the one hand, and having the hollow spindle guided by means of a linear guide on the other hand, the elements of the device which can be moved relative to a housing are guided reliably for the back-and-forth movement which is necessary for operation. At the same time, an anti-twist prevention is realized for the hollow spindle and the piston. In a purposeful and robust manner, the linear guide has two guide rods and several guide sleeves which slide on the guide rods.

In an additional alternative implementation form of the invention, the inlet valve can be activated pneumatically or magnetically, since for both of these variants only little design effort is necessary. In an especially preferred manner, the discharge line is connected directly to the interior of the cylinder, and connects downstream to the discharge line of a fluid applying device, so that a complete device for transporting and applying a fluid is realized which can be attached to a robot arm, so as to be able, for example, to apply adhesive to motor vehicle parts in the manufacture of automobiles.

Since heated adhesives and sealants may be processed in many industrial applications, in accordance with an additional refinement of the invention a heating system is provided to heat the cylinder, so that the adhesive or sealant is kept at a preset temperature, especially during intermittent operation with relatively long interruptions in transport.

BRIEF DESCRIPTION OF THE DRAWINGS

The invention is described below on the basis of a sample implementation of a device for transporting fluids according to the invention, with reference to the accompanying drawings. The illustrations show the following.

DETAILED DESCRIPTION OF THE PREFERRED EMBODIMENT

Figure 1:
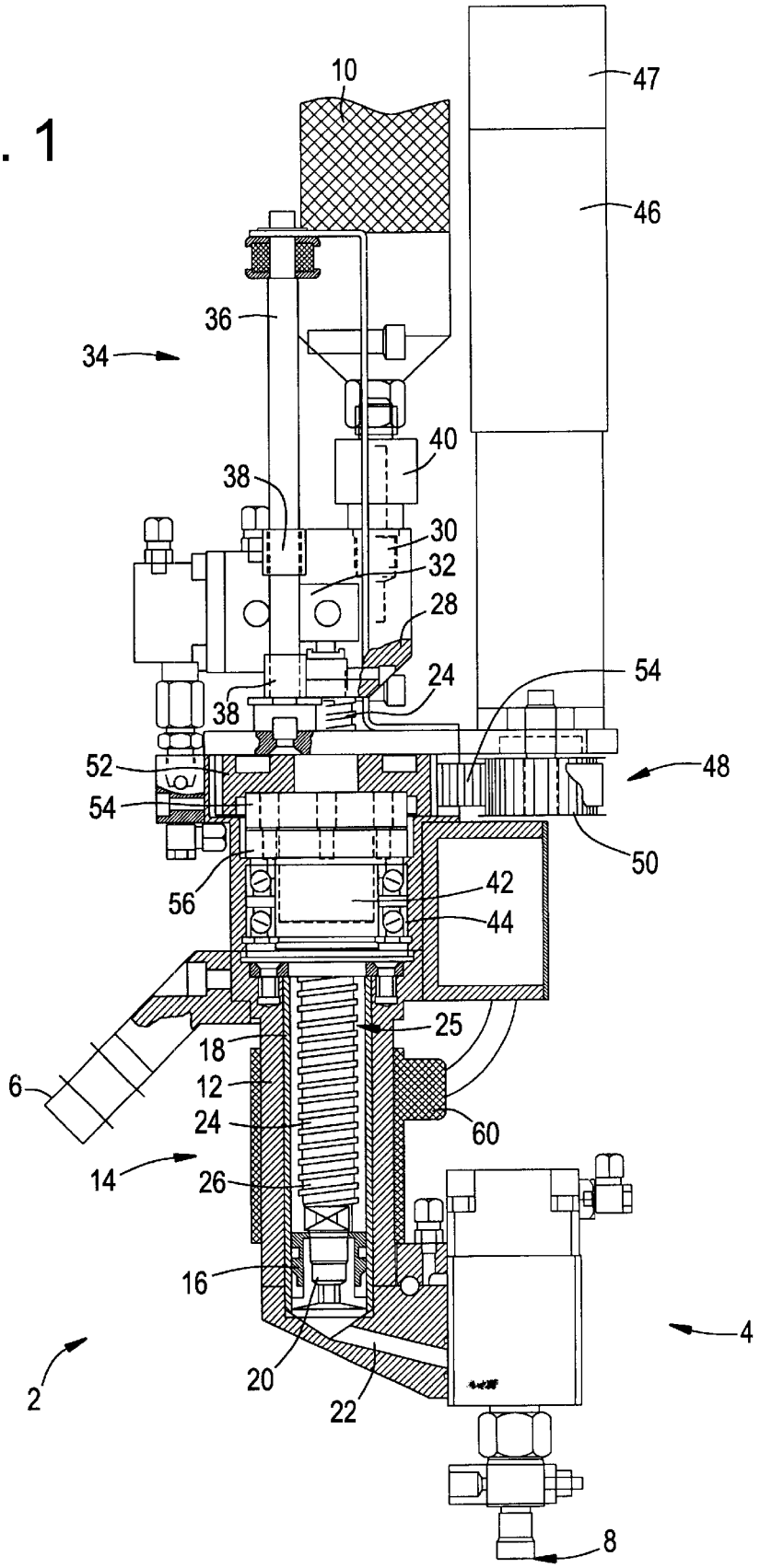
FIG. 1 illustrates a device in accordance with the invention, in a partially sectional view.
Figure 2:
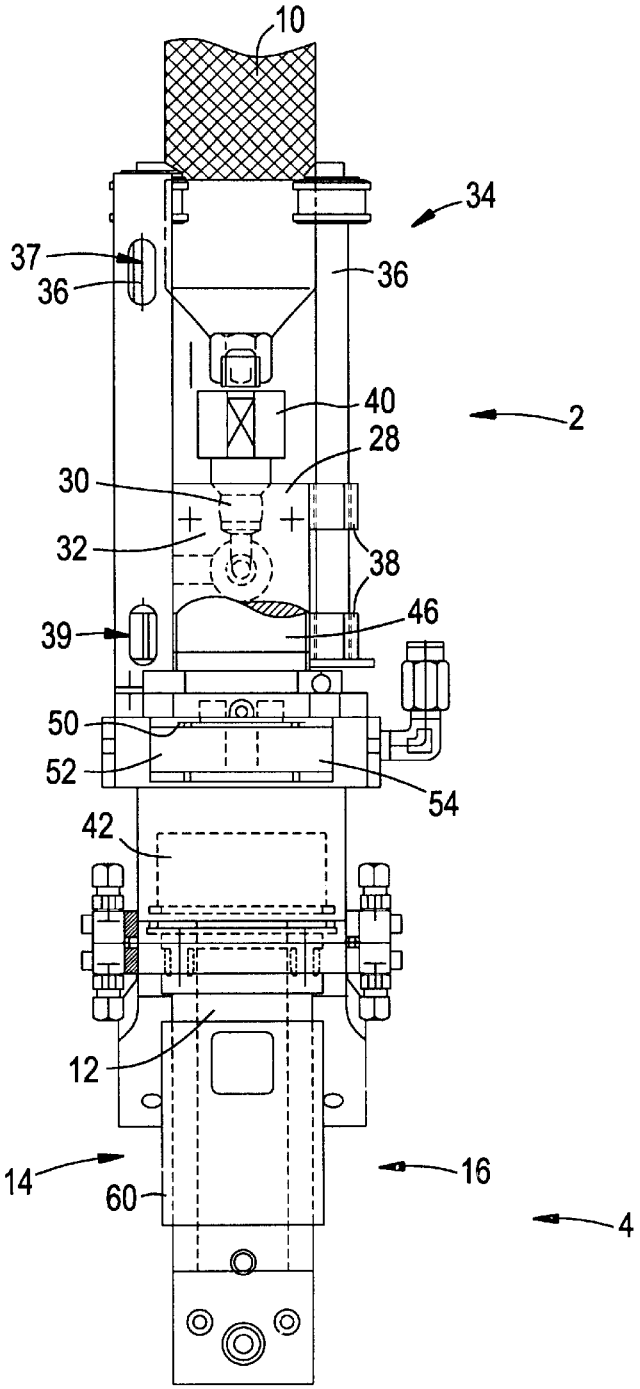
FIG. 2 is a side view of the device from FIG. 1.
Figure 3:
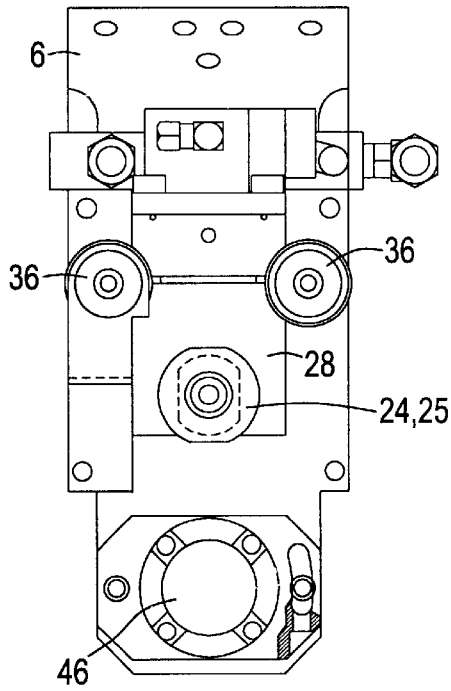
FIG. 3 is a top view of the device shown in FIGS. 1 and 2.

The device shown in FIGS. 1 to 3 is used to transport and then to apply viscous adhesive or sealing materials on surfaces of substrates such as body parts of motor vehicles, and consists essentially of a fluid transporting device 2 and a fluid application device 4 which is coupled thereto. The entire device is removably attached by means of an attaching element 6 to a robot arm (not shown) or a jig of a production facility, so that the fluid application device 4, which has a discharge jet for delivering adhesive or sealant, can be positioned relative to the substrate and possibly moved. The fluid application device 4 also contains an electrically or pneumatically activated application valve (not shown), by means of which the fluid channel formed inside the fluid application device 4 can optionally be opened or interrupted.

The fluid transport device 2 has a supply line 10 in the form of a flexible and heatable hose, which can be connected to a fluid source (not shown), a cylinder 14 formed in a metal housing 12, and a piston 16 which can move in the cylinder 14.

The cylinder 14 formed on the housing 12 has an interior which is limited by a tube-like cylindrical sleeve 18 which is inserted into the housing 12. Sleeve 18 is made of a wear-resistant metal. The piston 16 is sealed against the inner surface of the cylindrical sleeve 18 by means of appropriate seals. The piston 16 has a fluid channel 20 running in the axial direction, which expands like a funnel in its lower section, so that fluid flows into the interior of the cylinder beneath the piston 16 at a lower speed than the flow speed in the cylindrical section of the fluid channel 20. The volume of the interior of the cylinder 14 is defined at any given time by the position of the piston 16 within the cylinder 14. In FIG. 1 the piston 16 is located in its lower stop position, in which the interior space of the cylinder 14 below the piston 16 is minimal.

The interior space of the cylinder 14 below the piston 16 communicates directly with a discharge line 22 which is cylindrical in cross section, through which fluid can be introduced into the fluid application device 4. Inside the fluid application device 4 there is a fluid channel (not shown), which leads from the discharge line 22 to the discharge jet 8.

A piston rod 24 is designed in the form of a hollow spindle 25 with male threading, and has a fluid channel running in the axial direction which communicates with the fluid channel 20 of the piston 16. At its lower end section on the end toward the piston 16, the piston rod 24 is solidly connected to the piston 16. The outside diameter of the piston rod is smaller than the inside diameter of the cylindrical sleeve 18, so that there is no contact between the piston rod 24 and the cylindrical sleeve 18.

On its upper end section, on the end away from the piston 16, the piston rod 24 in the form of a hollow spindle 25 is connected to a housing 28. The housing 28 contains a channel 30, partially shown, which makes a connection between the supply line 10 in the form of a hose and the fluid channel 26 formed in the hollow spindle 25. By means of an adapter 40, there is a connecting channel between the supply line 10 and the channel 30 within the housing 28. In addition, the housing 28 holds an inlet valve 32, which is inserted into the channel 30 between the supply line 10 and the end section of the hollow spindle 25. This inlet valve 32 can be moved optionally to an open or a closed position. The inlet valve 32 makes it possible to interrupt the feeding of fluid from the supply line 10 through the channel 30, the fluid channel 26 inside the hollow spindle 25, and through the fluid channel 20 of the piston 16 into the interior of the cylinder 14 beneath the piston 16. In the open position the fluid channel or fluid flow path described above is released. The inlet valve 32 is activated pneumatically.

The housing 28, which is made of a rigid material, preferably metal, the upper end section of the hollow spindle 25 which is rigidly connected to the housing 28, and the inlet valve 32 are guided in a straight line by means of a linear guide 34. The linear guide 34 has two glide rods 36 which are parallel to each other and [at some] spaced apart, and four guide sleeves 38 which slide on the guide rods 36. Because of the attachment of the hollow spindle 25 to the linear-oriented housing 28, the hollow spindle 25 together with the guidance implemented inside the cylinder 14 by the piston 16 is centered within the cylinder 14 and can carry out a linear up-and-down movement without being caused to rotate.

As FIG. 2 shows, on the end sections of the guide rods 36 there are electric switches 37 and 39 which supply an electrical signal when the upper and lower end positions of the spindle 24 and the piston 16 are reached, in order to switch off the electric motor 46. These switches 37, 39 may switch the electric motor 46 off directly.

To move the piston rod 24 in the form of a hollow spindle 25, together with the piston 16, up and down, there is a drive 42 element which is mounted on the housing 12 in such a way that it can rotate. This drive element 42 has female threading which engages the male threads of the piston rod 24, which is in the form of a hollow spindle 25. The drive element 42 is designed as a threaded sleeve, and is mounted to the housing 12 by means of a roller bearing 44. By rotating the drive element 42, and because of the engagement with the hollow spindle 25, it exerts an axial force on the latter in an upward or downward direction, depending on the direction of rotation, which leads to an upward or downward movement of the piston 16 inside the cylinder 14 and thus either to ejection of fluid from or intake into the interior of the cylinder 14.

The drive element 42 is driven by means of an electric motor 46 and an intermediate gearset 48. The gearset 48 has a first gear wheel 50 which is coupled to the driveshaft of the electric motor 46, a second gear wheel 52 which is coaxial to the hollow spindle 25, and a toothed belt 54 which passes around both gear wheels 50, 52. The gear wheel 52, which can thus be turned by the electric motor 46, is coupled to the drive element 42 by means of two connecting disks 56, 58.

The electric motor 48 is coupled to a sensor 47 for the angle of rotation, which supplies information about the present angle of rotation, speed of rotation and direction of rotation of the driveshaft of the electric motor and the spindle 25, and thus about the position, speed and direction of movement of the piston 16, and ultimately about the quantity of fluid being transported. The rotational angle sensor 47 is of high resolution, so that the information mentioned above is very exact.

An electric heater 60 with a resistance heating element is placed around the portion of the housing 12 which forms the cylinder 14, in order to heat the cylinder 14. The heater 60 is controlled by a controlling and regulating unit, which is not shown.

To fill the interior of the cylinder 14, the inlet valve 32 is first moved to its open position by means of the controlling and regulating unit. At the same time, the application valve for the fluid application device 4 is moved to the closed position. Immediately thereafter, the electric motor 46 is switched on, so that gear wheel 50 and gear wheel 52 are turned, the latter at a reduced speed which corresponds to the translation ratio compared to gear 50. Together with gear wheel 52, the drive element 42 is rotated. Because the female threads of the drive element 42 engage the male threads of the piston rod 24 in the form of a hollow spindle 25, the piston 16 is moved upward from its lower stop position, shown in FIG. 1, in the direction of its upper stop position. At the same time the hollow spindle 25, the housing 28, the inlet valve 32, the adapter 40 and the lower section of the supply line 10 in the form of a hose are moved upward translationally. During the upward movement, fluid such as adhesive or sealant is transported through the hose, the adapter 40, the channel 30, the inlet valve 32, which is in the open position, through the axial fluid channel 26 formed in the piston rod 24 and the axial fluid channel 20 formed in the piston 16, into the interior space of the piston 16 beneath the cylinder.

When the piston 16 has reached its upper stop position, the drive motor 46 is switched off automatically by activating the electric switch 37, so that the movement of the piston 16 and the piston rod 24 is interrupted.

To transport fluid from the fluid transporting device 2 through the discharge line 22 to the fluid application device 4, the electric motor 46 is switched on in the direction opposite to the direction for filling the cylinder 14, so that the drive element 42 is now rotated in the opposite direction by means of the gearset 48, so that the hollow spindle 25 together with the piston 16 in FIG. 1 is moved downward within the cylinder 14, so that fluid which is beneath the piston 16 is transported through the discharge line 22 into the fluid application device 4. The inlet valve 32 is in the closed position while the piston 16 is moving downward. By means of the fluid application device 4, the adhesive can be applied to a substrate through the discharge jet 8, possibly by means of pressurized gas. The fluid application device 4 is used either for simple application of fluid, or possibly for applying fluid under the effect of a flow of pressurized gas on the fluid (such as rotary spraying). When the piston 16 reaches its lower stop position, the electric motor 46 is switched off by activating the switch 39. The fluid transport device 2 is then ready for another filling procedure as described above, to fill the interior of the cylinder 14 with adhesive.

The piston rod 24 in the form of a hollow spindle 25 has a dual function. On the one hand, fluid is conducted through the hollow spindle 25 from the supply line 10 into the interior of the cylinder 14. On the other hand, the hollow spindle 25 serves for propulsion, that is, to shift the piston 16 axially within the cylinder 14. This gives the device according to the invention a very compact design, and permits precisely measured transport of the fluid. The transport stream can be regulated precisely by adjusting the speed of the electric motor 46, and depending on the translation ratio of the gearset 48 very slow displacement speeds of the piston 16 can be realized. The dwell time of fluid elements inside the cylinder 14 is very uniform, that is, the first fluid into cylinder 14 is the first fluid out of cylinder 14.

While the present invention has been illustrated by a description of a preferred embodiment and while this embodiment has been described in some detail, it is not the intention of the Applicant to restrict or in any way limit the scope of the appended claims to such detail. Additional advantages and modifications will readily appear to those skilled in the art. The various features of the invention may be used alone or in numerous combinations depending on the needs and preferences of the user. This has been a description of the present invention, along with the preferred methods of practicing the present invention as currently known.

However, the invention itself should only be defined by the appended claims, wherein I claim:

1. An apparatus for providing a volume of a fluid from a fluid source, comprising:

a body including a piston cylinder with a first variable volume compartment and a second variable volume compartment having a fluid outlet;

a piston assembly positioned within said piston cylinder and mounted for reciprocating movement within said piston cylinder, said piston assembly including a piston dividing said piston cylinder into said first and second variable volume compartments and a fluid passageway having a first port in fluid communication with said second variable volume compartment and a second port configured for fluid communication with the fluid source;

a flow control device operative to selectively interrupt fluid flow in said fluid passageway from the fluid source to said second variable volume compartment, said flow control device having a closed position that interrupts fluid flow through said fluid passageway and an open position that permits fluid flow through said fluid passageway into said second variable volume compartment; and a rotatable drive element operatively coupled with said piston assembly such that rotation of said drive element reciprocates said piston in first and second opposed directions within said piston cylinder to alternately fill said second variable volume compartment with the volume of fluid, when said flow control device is in the open position, and eject the volume of fluid from said second variable volume compartment through said fluid outlet when said flow control device is in the closed position.

2. The apparatus of claim 1 wherein:

said piston assembly includes a piston rod attached to said piston and at least partially positioned within said second variable volume compartment; and said fluid passageway includes a first channel within said piston and a second channel within said piston rod, said first and second channels coupled in fluid communication with one another, said first channel further adapted to be coupled in selective fluid communication with the fluid source and said second channel further coupled in fluid communication with said second variable volume compartment.

3. The apparatus of claim 1 wherein said piston rod is threadingly engaged with said drive element so that rotation of said drive element reciprocates said piston in said first and second opposed directions relative to said piston cylinder.

4. The apparatus of claim 3 wherein:

said piston rod includes a hollow spindle and a plurality of male threads positioned on said hollow spindle; and said drive element includes an annular sleeve having an inner bore and a plurality of female threads positioned on said inner bore and adapted to threadingly engage said plurality of male threads.

5. The apparatus of claim 3 wherein said drive element is rotatably mounted to said body and said piston assembly is movable relative to said drive element to provide reciprocation of said piston in said first and second opposed directions.

6. The apparatus of claim 3 further comprising a motor operatively coupled with said drive element, said motor capable of rotating said drive element in a first angular direction for moving said piston in said first opposed direction within said piston cylinder to fill said second variable volume compartment with the volume of fluid and further capable of rotating said drive element in a second angular direction for moving said piston in said second opposed direction for ejecting the volume of fluid from said second variable volume compartment through said fluid outlet.

7. The apparatus of claim 1 wherein said flow control device is a flow control valve actuated by one of a pneumatic actuator and a magnetic actuator.

8. The apparatus of claim 1 further comprising a fluid application device coupled in fluid communication with said fluid outlet of said second variable volume compartment, said fluid application device operable for applying the volume of the fluid to a substrate.

9. The apparatus of claim 1 further comprising a linear guide operative to guide said piston assembly for linear reciprocating movement in said first and second opposed directions relative to said piston cylinder.

10. The apparatus of claim 1 further comprising a sleeve within said piston cylinder, said sleeve positioned between said piston and said piston cylinder, and said sleeve formed of a wear-resistant material.

11. The apparatus of claim 1 wherein a portion of said fluid passageway adjacent to said first port is flared so as to increase in diameter in the direction of fluid flow from said fluid passageway into said second variable volume compartment.

* * * * *